United States Patent [19]

Aoki

[11] Patent Number: 4,563,997

[45] Date of Patent: Jan. 14, 1986

[54] CONTROL SYSTEM AND METHOD FOR COMPREX SUPERCHARGER

[75] Inventor: Hachiro Aoki, Higashimatsuyama, Japan

[73] Assignee: Diesel Kiki Co., Ltd., Tokyo, Japan

[21] Appl. No.: 693,112

[22] Filed: Jan. 22, 1985

[30] Foreign Application Priority Data

Feb. 1, 1984 [JP] Japan ..... 59-16821

[51] Int. Cl.[4] ..... F02B 33/42

[52] U.S. Cl. ..... 123/559; 123/561; 123/565

[58] Field of Search ..... 123/559, 561, 565; 417/64

[56] References Cited

U.S. PATENT DOCUMENTS

| | | | |
|---|---|---|---|
| 2,970,745 | 2/1961 | Berchtold | 123/559 X |
| 3,011,487 | 12/1961 | Berchtold | 123/559 |
| 3,270,730 | 9/1966 | Timoney | 123/561 |
| 3,640,254 | 2/1972 | Manfredi | 123/565 X |
| 4,530,339 | 7/1985 | Oguma et al. | 123/561 |

FOREIGN PATENT DOCUMENTS

| | | |
|---|---|---|
| 381153 | 8/1960 | Japan . |
| 53-32530 | 9/1978 | Japan . |

OTHER PUBLICATIONS

Brown, Boverie and Co. publication No. CH-T123143D, "Aufladung von Fahrzeugdieselmotoren mit Comprex ®", special printing from *Automobil-Industrie,* Jan. 1977.

*Primary Examiner*—Michael Koczo

*Attorney, Agent, or Firm*—Frishauf, Holtz Goodman & Woodward

[57] ABSTRACT

A "comprex" supercharger, which has a rotor formed along its whole periphery with a plurality of axial cells wherein air introduced into the cells for supply to an internal combustion engine is compressed by engine exhaust gas introduced into the cells, is controlled by a control system such that a drive means for the rotor is controlled by an electronic control unit in response to output from engine operating condition sensors to control the rotational speed of the rotor so as to achieve optimum supercharging pressure to operating conditions of the engine.

5 Claims, 7 Drawing Figures

CONTROL SYSTEM AND METHOD FOR COMPREX SUPERCHARGER

BACKGROUND OF THE INVENTION

This invention relates to a "comprex" supercharger for internal combustion engines, and more particularly to a control system for controlling a "comprex" supercharger of this kind, which is capable of controlling the supercharger so as to achieve supercharging pressure optimum to operating conditions of the engine.

Among known superchargers for internal combustion engines, particularly diesel engines, is a "comprex" supercharger which is adapted to compress air directly by exhaust gas pressure and then supplies the compressed air as intake air to the engine. Such "comprex" supercharger typically comprises a rotor formed along its whole periphery with a plurality of axially extending cells arranged circumferentially of the rotor, an exhaust gas inlet arranged opposite the cells at one end of the rotor, an air inlet arranged opposite the cells at the other end of the rotor, and drive means drivingly coupling the rotor to an internal combustion engine for rotating the rotor. Fresh air through the air inlet is introduced into the cells at the one end of the rotating rotor and compressed by the pressure of engine exhaust gas introduced into the cells at the other end of the rotor, and the compressed air, is supplied to the engine. However, such conventional "comprex" supercharger has the drawback that while the propagation velocity of pressure-shock wave of exhaust gas in the cells is variable depending upon operating conditions of the engine, the rotor is rotated with a constant speed ratio to the engine speed, thereby failing to obtain optimum supercharging pressure to operating conditions of the engine.

SUMMARY OF THE INVENTION

It is an object of the invention to provide a control system for a "comprex" supercharger for internal combustion engine, which is capable of controlling the supercharger so as to achieve supercharging pressure optimum to operating conditions of the engine throughout the whole operating range of the engine, thereby improving the supercharging efficiency.

It is a further object of the invention to provide a control system of this kind, which is capable of controlling the rotational speed of the rotor of the "comprex" supercharger so as to achieve supercharging pressure optimum to operating conditions of the engine, thereby avoiding unnecessarily high speed rotation of the rotor for prolonging the life thereof.

The present invention provides a control system for controlling a "comprex" supercharger for an internal combustion engine, which includes a rotor formed along a whole periphery thereof with a plurality of cells extending axially of the rotor, means for introducing exhaust gas into the cells at one end of the rotor during rotation thereof, means for introducing air into the cells at another end of the rotor during rotation thereof, the air introduced into the cells being compressed by the exhaust gas introduced into the cells, and means for feeding the compressed air to the engine.

The control system according to the invention comprises: drive means for rotatively driving the rotor, sensor means for sensing operating conditions of the engine; and electronic control means responsive to output from the sensor means for controlling the drive means to control the rotational speed of the rotor so as to achieve supercharging pressure optimum to operating conditions of the engine.

The above and other objects, features and advantages of the invention will be more apparent from the ensuing detailed description taken in conjunction with the accompanying drawings.

DETAILED DESCRIPTION

Figure 1:
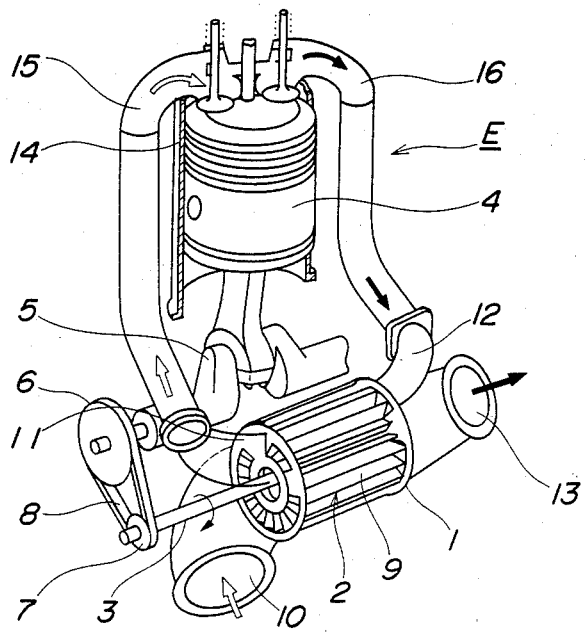
FIG. 1 is a schematic perspective view of a conventional typical "comprex" supercharger.

Referring first to FIG. 1, there is illustrated a "comprex" supercharger to which is applicable the control system according to the invention. Accommodated within a rotor housing 1 is a rotor 2 for rotation therein, of which a rotary shaft 3 is coupled to a crankshaft 5 coupled to pistons 4 of an internal combustion engine E, by means of pulleys 6 and 7, and a belt 8, to be rotatively driven by the crankshaft 5 with a predetermined speed ratio to the speed of the latter.

The rotor 2 has its whole outer peripheral surface formed with a plurality of cells 9 in the form of axially extending slits arranged circumferentially of the rotor 2. The slits 9 each have open opposite ends. An air inlet 10 and an air outlet 11 are arranged at one side of the rotor housing 1 (i.e. at one end of the rotor 2), and an exhaust gas inlet 12 and an exhaust gas outlet 13 at the other side of the rotor housing 1 (i.e. at the other end of the rotor 2), respectively. The air outlet 11 is connected with an intake passage 15 communicating with the interior of cylinders 14 of the engine, and the exhaust gas inlet 12 is connected with an exhaust passage 16 communicating with the interior of the engine cylinders 14. The air inlet 10 and the exhaust gas outlet 13 have one ends thereof disposed opposite corresponding ends of cells 9 in axial alignment with each other. The air outlet 11 and the exhaust gas inlet 12 likewise have one ends thereof disposed opposite the other ends of cells 9 in axial alignment with each other.

Figure 2:
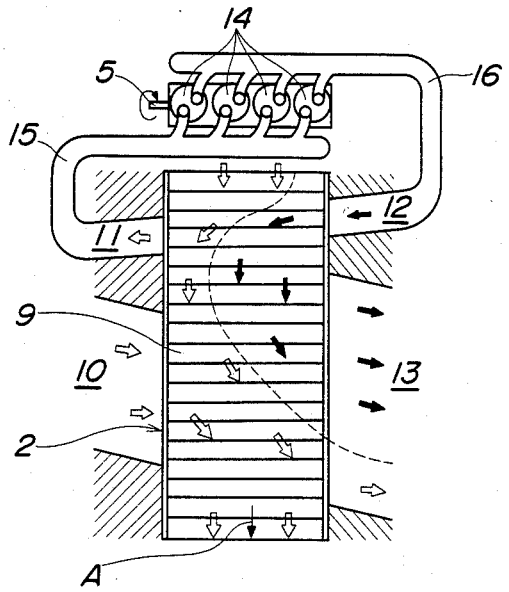
FIG. 2 is a schematic view of essential part of the supercharger of FIG. 1, useful for explaining the operation of the supercharger.

With the above arrangement of the "comprex" supercharger, as shown in FIG. 2, fresh air introduced into each cell 9 through the air inlet 10 is circumferentially moved to a location opposite the exhaust gas inlet 12 with rotation of the rotor 2, where it collides with a shock wave of exhaust gas introduced into the cell 9 through the exhaust gas inlet 12 to be compressed thereby as indicated by the white arrows in FIG. 2, and the compressed air is delivered through the air outlet 11 into the engine cylinders 14. Incoming exhaust gas in each cell 9 is trapped in the same cell to become expanded and quiescent therein. Then, as the rotor 2 rotates in the direction indicated by the arrow A in FIG. 2, the trapped gas in the cell 9 is circumferentially moved to a location opposite the air inlet 10 and the exhaust gas outlet 13 whereby the cell 9 is scavenged by further fresh air introduced through the air inlet 10.

Figure 3:
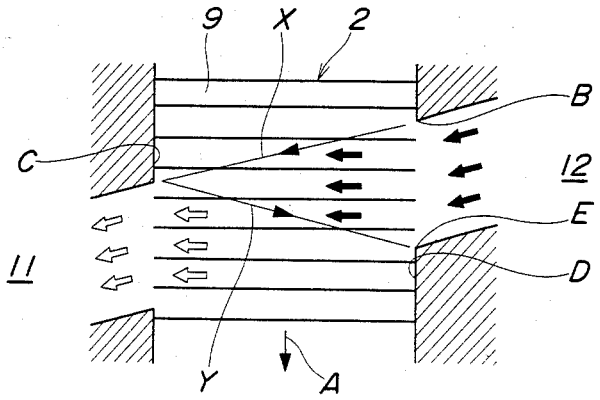
FIG. 3 is a schematic view of essential part of the supercharger, showing a pressure shock wave of exhaust gas at normal speed rotation of the supercharger rotor in FIG. 1.

Since the "comprex" supercharger compresses fresh air directly by the exhaust gas pressure in the above-mentioned manner, the engine can produce large torque at low speed and be quickly responsive to the driver's requirement for acceleration. However, while the propagation velocity of a pressure shock wave of exhaust gas in each cell 9 from the exhaust gas inlet 12 to the air outlet 11 can vary in dependence on operating conditions of the engine, the rotor is rotated at a speed correspondingly solely to the engine rotational speed being a parameter of the operating condition of the engine and with a predetermined speed ratio thereto. This often results in that the supercharging pressure obtained by the "comprex" supercharger does not always assume appropriate values to operating conditions of the engine. This will be explained with reference to FIGS. 3 and 4. A shock wave X of exhaust gas introduced into a cell 9 through the corresponding end of the exhaust gas inlet 12 advances in the cell 9 from a guide end edge portion B of the inlet 12 and is reflected by a wall surface C in the vicinity of the air outlet 11. The resulting reflected wave Y moves toward the above corresponding end of the exhaust gas inlet 12. It is so designed that at normal speed operation of the engine, i.e. at normal speed rotation of the rotor 2, as shown in FIG. 3, the reflected wave Y reaches a wall surface portion D at a location forward of a forward end edge portion E of the exhaust gas inlet 12 in the direction of rotation of the rotor 2 indicated by the arrow A in FIG. 3. However, when the engine is operating in a low speed and high load condition, the shock wave X has a high propagation velocity whereas the rotor speed 2 is low. As a result, the reflected wave Y can reach a radially central portion of the open end of the exhaust gas inlet 12 rearward of the forward end edge portion E in the direction of rotation of the rotor 2, as shown in FIG. 4, causing a backflow of air into the exhaust gas inlet 12 from the cell 9, resulting in unstable supercharging pressure.

Figure 4:
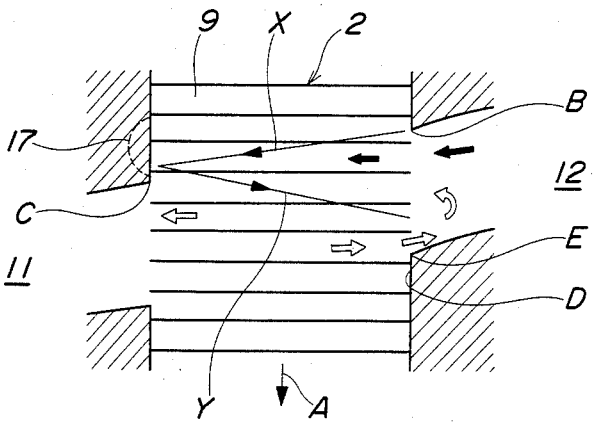
FIG. 4 is a view similar to FIG. 3 at low speed rotation of the rotor.

Conventionally, to weaken such harmful reflected wave Y, it has been proposed, e.g. by Japanese Patent Publication No. 38-1153 and Japanese Patent Publication No. 53-32530, to form a pocket 17 in the wall surface portion C in the vicinity of the compressed gas inlet 11, as indicated by the broken line in FIG. 4, so as to reduce the reflecting shock of the pressure shock wave X. However, this proposed method is merely effective to weaken the reflected wave Y, still failing to solve the problem that the "comprex" supercharger cannot provide optimum supercharging pressure for the engine throughout its whole operating range.

Figure 5:
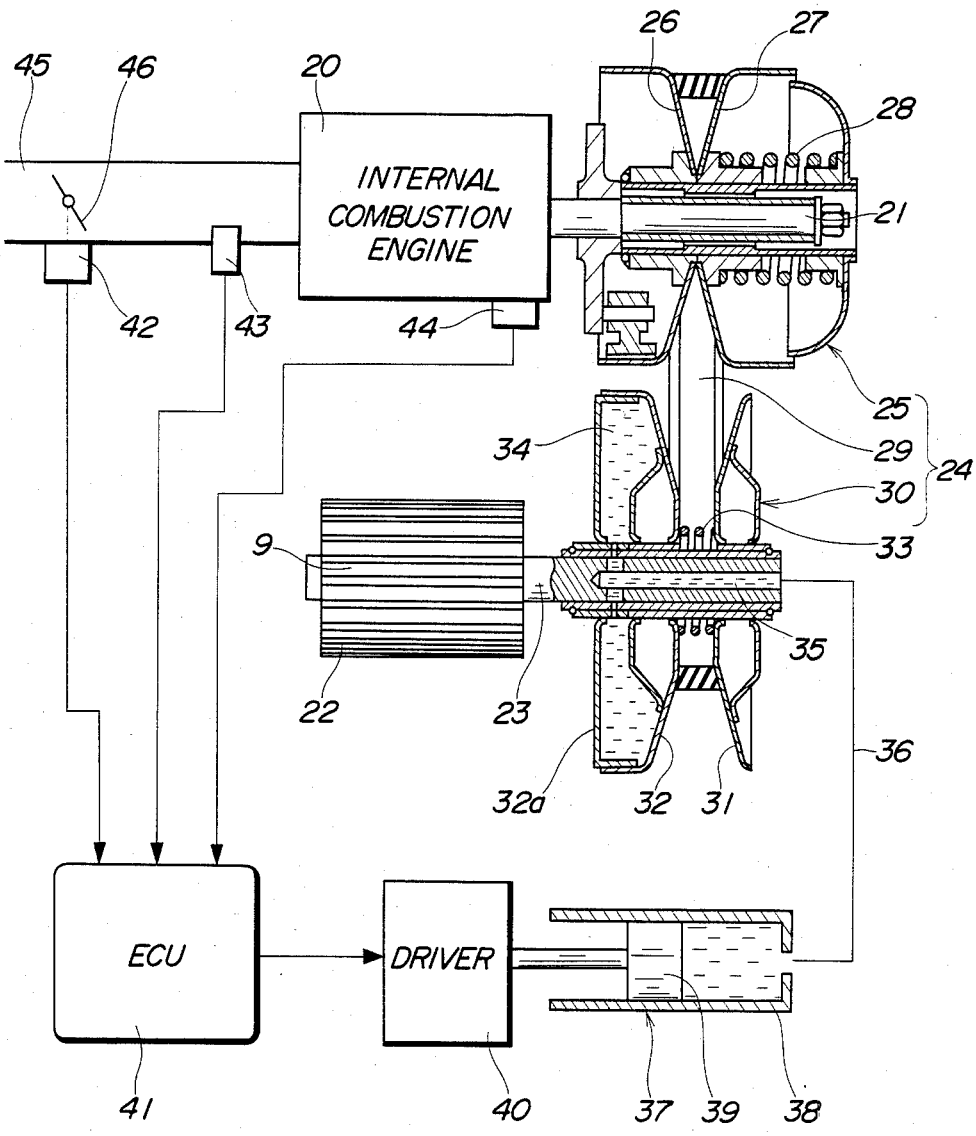
FIG. 5 is a block diagram, partly in section, of a control system for a "comprex" supercharger according to an embodiment of the invention.

FIG. 5 schematically illustrates an embodiment of the control system according to the present invention. An internal combustion engine 20 has an output shaft (crankshaft) 21 drivingly coupled to a rotary shaft 23 of a rotor 22 of a "comprex" supercharger by means of a belt transmission 24. In FIG. 5, only the rotor 22 is illustrated, while the illustration of the other component parts such as air inlet, air outlet, exhaust gas inlet and exhaust outlet is omitted, since they can be identical with those illustrated in FIG. 1 and described with reference to FIG. 1.

The belt transmission 24 comprises a drive pulley 25 of a variable pitch diameter type provided on the output shaft 21 of the engine 20, a driven pulley 30 of a variable pitch diameter provided on the rotary shaft 23 of the rotor 22, and a belt 29 formed of a V-belt engaged with the two pulleys 25, 30. The drive pulley 25 comprises a stationary drive face element 26 secured on the output shaft 21, a movable drive face element 27 axially movably mounted on the output shaft 21, and a compression spring 28 urging the movable drive face element 27 against the stationary drive face element 26. The movable drive face element 27 assumes an axial position where the urging force of the compression spring 28 and the tension of the belt 29 balance with each other. The driven pulley 30 comprises a stationary driven face element 31 secured on the rotary shaft 23 of the rotor 22, a movable driven face element 32 axially movably mounted on the rotary shaft 23, and a compression spring 33 urgingly interposed between the two driven face elements 31, 32. The movable driven face element 32 is fitted in an oiltight manner over an element **32*a* secured on the rotary shaft 23 for axial sliding on the element 32*a*, and cooperates with the element 32*a* to define a pressure oil chamber 34 therein. The movable driven face element 32 assumes an axial position where the sum of the urging force of the compression spring 33 and the tension of the belt 29 balances with the oil pressure within the pressure oil chamber 34**.

An oil passage 35 is formed in the rotary shaft 23 along its axis and communicates, on one hand, with the pressure oil chamber 34 and, on the other hand, with the interior of a cylinder 38 of an oil hydraulic actuator 37 by way of a passage 36. The oil hydraulic actuator 37 has a piston 39 drivenly coupled to a driver 40 which may comprise a stepping motor controlled by a control signal from an electronic control unit 41, hereinafter referred to, for actuating the piston 39.

Figure 6:
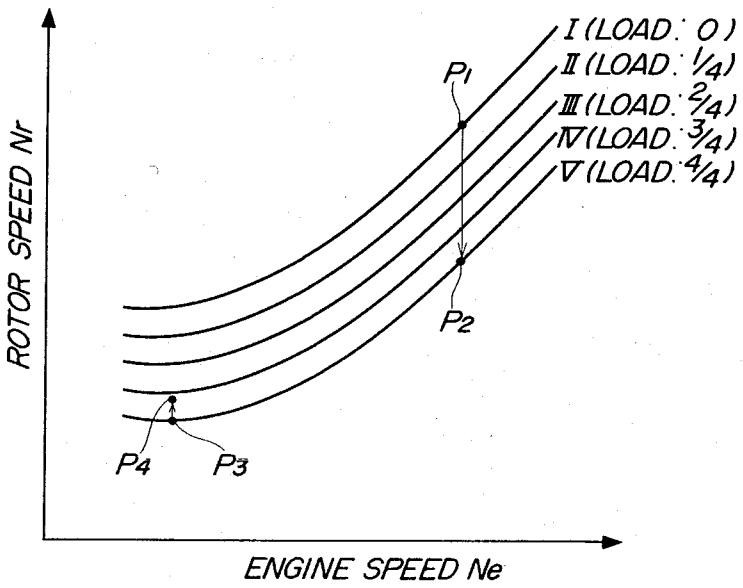
FIG. 6 is a view showing a rotor speed vs. engine speed and engine load map employed by the control system of the invention.

Electrically connected to the electronic control unit (ECU) 41 are a throttle opening sensor 42 for sensing the valve opening of a throttle valve 46 arranged in an intake passage 45 of the engine 20 with which the cells 9 can communicate, a supercharging pressure sensor 43 arranged in the intake passage 45 at a location downstream of the throttle valve 46 for sensing the intake pressure there as supercharging pressure, an engine speed sensor 44 for sensing the rotational speed of the engine 20, and, if required, various other engine parameter sensors, not shown. The electronic control unit 41 is responsive to output signals from these sensors to determine operating conditions of the engine 20, then determines a value of the rotational speed of the rotor 22 appropriate to the determined operating condition of the engine 20, and supplies a control signal corresponding to the determined rotor speed value to the driver 40, thereby controlling the rotational speed of the rotor 22 so as to achieve optimum supercharging pressure to operating conditions of the engine. FIG. 6 shows a map of rotor speed vs. engine speed and engine load applicable to the speed control of the rotor. According to this map, the electronic control unit 41 operates to select from a plurality of predetermined load lines I–V an optimum load line to a loaded condition of the engine determined from a throttle valve opening value sensed by the throttle valve opening sensor 42, and reads an optimum value of the rotor speed Nr corresponding to the selected optimum load line as well as to a value of the engine speed Ne sensed by the engine speed sensor 44. Then, the electronic control unit 41 reads from a map, not shown, a desired target value of supercharging pressure optimum to an operating condition of the engine detected by the parameter sensors including at least the throttle valve opening sensor 42 and the engine speed sensor 44, calculates the difference between the read desired supercharging pressure value and an actual supercharging pressure value sensed by the supercharging pressure sensor 43, corrects the above optimum rotor speed Nr value read from the FIG. 6 map, by an amount corresponding to the calculated difference, and supplies a control signal corresponding to the corrected rotor speed Nr value to the driver 40 for actuating same thereby.

The operation of the control system constructed as above will now be described. The supercharging pressure depends upon the depth of intrusion of exhaust gas into the cells 9, which depth is determined by the relationship between the rotor speed and the flow rate or flow speed of the exhaust gas. More specifically, assuming that the flow rate or flow speed of the exhaust gas remains constant, the higher the rotor speed, the smaller the depth of intrusion of exhaust gas into the cells 9, resulting in lower supercharging pressure. Therefore, when the engine operation transits from a high speed/-low load operating condition to a high speed/high load operating condition requiring high supercharging pressure, for instance, when the operating condition of the engine changes from a point $P_1$ to a point $P_2$ in FIG. 6, the electronic control unit 41 supplies the driver 40 with such a control signal as to cause rightward movement of the piston 39 as viewed in FIG. 5. As a result, the oil pressure within the pressure oil chamber 34 of the driven pulley 30 increases to cause rightward movement of the movable driven face element 32 to make smaller the gap between the driven face elements 31, 32 so that the pitch diameter of a portion of the belt 29 wound around the driven pulley 30 increases. Accordingly, the pitch diameter of a portion of the belt 29 around the drive pulley 25 decreases to reduce the ratio of the rotor speed to the engine speed so that the rotor speed drops. As a result, the depth of intrusion of exhaust gas into cells 9 increases so that the resulting supercharging pressure becomes equal to the desired value, while avoiding unnecessary high speed rotation of the rotor 22.

When the engine is operating in a low speed/high load operating condition, for instance, when it is operating at a point $P_3$ in FIG. 6, the electronic control unit 41 actuates the driver 40 so as to cause leftward movement of the piston 39 as viewed in FIG. 5, to reduce the pitch diameter of the belt 29 around the driven pulley 30 while increasing the pitch diameter of the belt 29 around the drive pulley 25. As a result, the rotor speed increases to a point $P_4$ in FIG. 6, preventing the phenomenon of the reflected wave Y previously explained with reference to FIG. 4 to achieve desired supercharging pressure.

Figure 7:
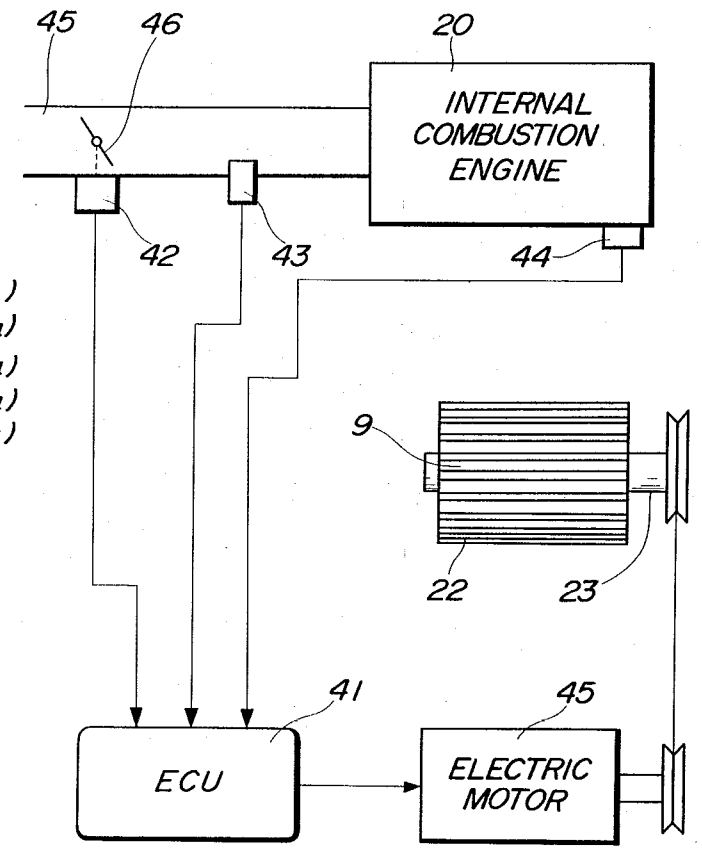
FIG. 7 is a block diagram of a control system for a "comprex" supercharger according to another embodiment of the invention.

Although in the illustrated embodiment a belt transmission 24 of a stepless speed change type is employed for transmitting engine power to the rotor 22, this is not limitative to the invention but other type transmission means such as a belt transmission of a stepwise speed change type may be alternatively employed. Furthermore, the rotor 22 may be rotatively driven by a power source other than the engine 20, such as an electric motor 45 shown in FIG. 7, which may be formed e.g. of a direct current servomotor, wherein the rotational speed of the motor 45 is controlled by a control signal from the electronic control unit 41.

While the invention has been described in its preferred embodiments, obviously modifications and variations will occur to those skilled in the art within the scope of the present inventive concepts which are delineated by the following claims.

What is claimed is:

1. A control system for controlling a "comprex" supercharger for an internal combustion engine, said supercharger including a rotor formed along a whole periphery thereof with a plurality of cells extending axially of the rotor and arranged circumferentially thereof, means for introducing exhaust gas into said cells at one end of said rotor during rotation thereof, means for introducing air into said cells at another end of said rotor during rotation thereof, the air introduced into said cells being compressed by the exhaust gas introduced into said cells, and means for feeding the compressed air to said engine, said control system comprising: drive means for rotatively driving said rotor; sensor means for sensing operating conditions of said engine and for providing an output; and electronic control means responsive to said output from said sensor means for controlling said drive means to control the rotational speed of said rotor so as to achieve supercharging pressure optimum to operating conditions of said engine.

2. A control system as claimed in claim 1, wherein said engine has an output shaft, and said drive means comprises a belt transmission drivingly coupling said output shaft of said engine to said rotor.

3. A control system as claimed in claim 2, wherein said rotor has a rotary shaft, and said belt transmission comprises a drive pulley having a variable pitch diameter and provided on said output shaft of said engine, a driven pulley having a variable pitch diameter and provided on said rotary shaft of said rotor, and a belt engaged with said drive pulley and said driven pulley.

4. A control system as claimed in claim 1, wherein said drive means comprises an electric motor drivingly coupled to said rotor.

5. A control method of controlling a "comprex" supercharger for an internal combustion engine, said supercharger including a rotor formed along a whole periphery thereof with a plurality of cells extending axially of the rotor and arranged circumferentially thereof, means for introducing exhaust gas into said cells at one end of said rotor during rotation thereof, means for introducing air into said cells at another end of said rotor during rotation thereof, the air introduced into said cells being compressed by the exhaust gas introduced into said cells, and means for feeding the compressed air to said engine, said control method comprising the steps of: sensing load on said engine; sensing the rotational speed of said engine; sensing supercharging pressure of intake air being supplied to said engine; determining an optimum load line from the sensed engine load; determining an optimum value of the rotational speed of said rotor from the determined load line and the sensed engine rotational speed; determining an optimum value of the supercharging pressure corresponding to at least the sensed engine load and the sensed engine rotational speed; determining the difference between the determined optimum supercharging pressure value and the sensed supercharging pressure; correcting the determined optimum value of the rotor rotational speed by the determined difference; and controlling the rotational speed of said rotor to the corrected optimum value thereof.

* * * * *